United States Patent [19]

Sakamoto

[11] Patent Number: 4,918,936

[45] Date of Patent: Apr. 24, 1990

[54] REFRIGERATING CYCLE UTILIZING COLD ACCUMULATION MATERIAL

[75] Inventor: Noriaki Sakamoto, Ibaraki, Japan

[73] Assignee: Kabushiki Kaisha Toshiba, Kawasaki, Japan

[21] Appl. No.: 338,342

[22] Filed: Apr. 13, 1989

Related U.S. Application Data

[63] Continuation of Ser. No. 153,713, Feb. 8, 1988, abandoned.

[30] Foreign Application Priority Data

Feb. 27, 1987 [JP] Japan ..... 62-045762

[51] Int. Cl.[5] ..... F25B 41/00

[52] U.S. Cl. ..... 62/117; 62/198; 62/430

[58] Field of Search ..... 62/198, 430, 526, 514 R, 62/117

[56] References Cited

U.S. PATENT DOCUMENTS 4,227,379 10/1980 Onishi ..... 62/198
4,476,600 10/1984 Ianelli ..... 62/198
4,637,219 1/1987 Grose ..... 62/430 X
4,637,222 1/1987 Fujiwara et al. ..... 62/430 X

*Primary Examiner*—William E. Tapolcai
*Attorney, Agent, or Firm*—Cushman, Darby & Cushman

[57] ABSTRACT

A refrigerating cycle including a cold-accumulation material to be cooled comprises main evaporator for generating cold air to cool a refrigerator compartment, a cold-accumulation evaporator to cool the cold-accumulation material, a flowpath switching device, such as a three-way electromagnetic valve, to change the refrigerant flowpath between a first refrigerant flowpath to the main evaporator and a second refrigerant flowpath to the cold-accumulation evaporator respectively, and a refrigerant supply device, such as a compressor, a condenser, and a capillary tube connected in series, to supply refrigerant to the main evaporator and the cold-accumulation evaporator through the flowpath switching device. The outlet of the cold-accumulation evaporator is connected to the inlet of the evaporator to let the refrigerant which has not completely evaporated in the cold-accumulation evaporator flow into the main evaporator.

21 Claims, 2 Drawing Sheets

REFRIGERATING CYCLE UTILIZING COLD ACCUMULATION MATERIAL

This is a continuation of application Ser. No. 153,713 filed Feb. 8, 1988 which was abandoned upon the filing hereof.

BACKGROUND OF THE INVENTION

1. Field of the Invention

The present invention relates to cooling apparatus such as refrigerators, air conditioners, etc. utilizing a cold-accumulation material therein.

2. Description of the Prior Art

A cold-accumulation material is provided in a refrigerating device, such as a refrigerator and an air conditioner, in order to improve the efficiency of its refrigerating cycle. An example of such a refrigerating device is disclosed in Japanese Utility Model Publication No. 53-10586, filed on Oct. 9, 1973 in the name of Kenichi KAGAWA. In Japanese Utility Model Publication No. 53-10586, the refrigerating cycle has an auxiliary cooler and an auxiliary condenser placed within a case also containing a cold-accumulation material. The auxiliary cooler and the auxiliary condenser are connected in parallel with each other. When a load to be cooled is small, the auxiliary cooler cools the cold-accumulation material thereby accumulating an extra cooling capacity for later use. When the load to be cooled is large the auxiliary condenser supplements the condensing capacity of a main condenser by transferring heat between the cold-accumulation material and the main condenser. Thereby, the efficiency of the refrigerating cycle, especially the operating efficiency of the compressor, is improved.

Recently, there has been consideration of refrigerating cycles having cold-accumulation materials therein for the purpose of evening out power demand during a 24-hour day by better utilizing power which is not efficiently used, such as night-time power. As is shown in FIG. 1, a refrigerating cycle can be, for example, constituted as follows. A discharge side of a compressor 5 is connected through a condenser 7 and a first capillary tube 9 to an inflow side of a flowpath control electromagnetic valve 11. The valve 11 has two outflow ports. One outflow port connects through a second capillary tube 13 to an inflow port of a main evaporator 15. An outflow port of the main evaporator 15 connects through an accumulator 17 to an intake side of the compressor 5, whereby there is established a refrigerant flowpath for an ordinary cooling operation, which we shall also refer to as first mode cooling. During first mode cooling, refrigerant compressed by compressor 5 flows into the main evaporator 15 and evaporates therein to cool refrigerator compartments. The other outflow port connects through a third capillary tube 19 to an inflow-port of a cold-accumulation evaporator 21. An outflow port of the cold-accumulation evaporator 21 connects through the accumulator 17 to the intake side of the compressor 5, whereby there is established a refrigerant flowpath for a cold-accumulation operation which we shall also refer to as third mode operation. When the cold-accumulation material 23 is to be cooled (third mode), refrigerant compressed by compressor 5 flows into the cold-accumulation evaporator 21 and evaporates therein to cool the cold-accumulation material.

A thermosiphon 25 having a electromagnetic valve 27 therein is in thermal contact with both the main evaporator 15 and the cold-accumulation evaporator 21 and hence the cold-accumulation material 23. Cooling by means of the cold-accumulation material also referred to herein as second mode cooling is effected by heat transfer between the main evaporator 15 (and hence the refrigerator compartments) and the main evaporator 15 when the electromagnetic valve 27 is opened. Outflow ports of both the main evaporator 15 and the cold-accumulation evaporator 21 are connected to the accumulator 17. There may be different amounts of refrigerant evaporated in the respective evaporators during the ordinary cooling (first mode) carried out by main evaporator 15, and the cold-accumulation operation (third mode), carried out by the cold-accumulation evaporator 21.

During cold-accumulation operation (third mode) there may be a comparatively large amount of refrigerant flowing from the cold-accumulation evaporator 21. The cold-accumulation material 23 is thermally insulated from the surroundings. As the cold-accumulation operation continues, the amount of heat exchanged between the cold-accumulation evaporator 21 and the cold-accumulation material becomes smaller and hence the amount of refrigerant evaporated in the cold-accumulation evaporator 21 becomes smaller. The accumulator 17, therefore, may have to be designed so that the amount of refrigerant circulating in the refrigerating cycle has an appropriate valve in both ordinary cooling operation and cold-accumulation operation. If the accumulator capacity is too small, there is a risk of the phenomenon known as "liquid back-up" occurring. During liquid back-up, liquid refrigerant from the cold-accumulation evaporator 21 flows back into the compressor 5 during the cold-accumulation operation. This has an adverse effect on the reliability of the compressor 5 as well as lowering the efficiency of the refrigerating cycle. Simply increasing the size of the accumulator 17 involves the penalties of increased overall refrigerating device size and increased costs, as well as lowering the efficiency of the refrigerating cycle during the ordinary cooling operation. Therefore, the capacity of the accumulator is significant. The accumulator may have to be designed so that during both ordinary cooling operation and the cold-accumulation operation the amount of refrigerant circulating in the refrigerating cycle is appropriate. In general, such design, however, is very difficult. Therefore the accumulator capacity is usually designed to be larger than normally required to avoid any problem. Moreover, in the above-mentioned refrigerating cycle, liquid refrigerant flowing from the cold-accumulation evaporator 21 without having been completely evaporated therein may evaporate, to no useful effect, in the other parts, such as e.g., suction pipes, constituting the refrigerating cycle, thereby causing loss of efficiency.

SUMMARY OF THE INVENTION

It is an object of the present invention to improve the efficiency of a refrigerating cycle having a cold-accumulation material therein.

To accomplish the object described above, the present invention provides a refrigerating cycle with the cold-accumulation material an evaporator for cooling a refrigerator compartment, a cold-accumulation evaporator for cooling the cold-accumulation material, a flowpath switching device for switching between a first refrigerant flowpath to the evaporator and a second refrigerant flowpath to the cold-accumulation material respectively, and a refrigerant supplying device for supplying refrigerant to the evaporator and the cold-accumulation evaporator through the flowpath switching device. The outlet of the cold-accumulation evaporator is connected to the inlet of the evaporator.

BRIEF DESCRIPTION OF THE DRAWINGS

The present invention will be explained in detail with reference to accompanying drawings.

DETAILED DESCRIPTION OF THE PREFERRED EMBODIMENT

A presently preferred exemplary embodiment of the invention will be described with reference to the drawings.

Figure 1:
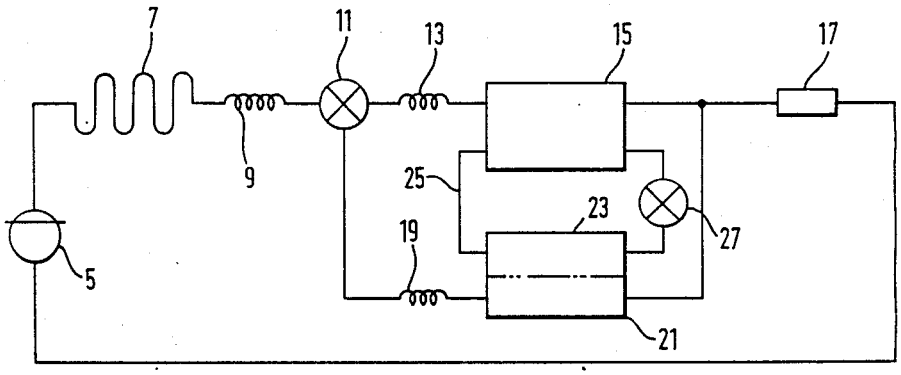
FIG. 1 RELATED ART
FIG. 1 is a schematic diagram of a refrigerating cycle illustrating an example of the related art (not necessary prior art to this invention).
Figure 2:
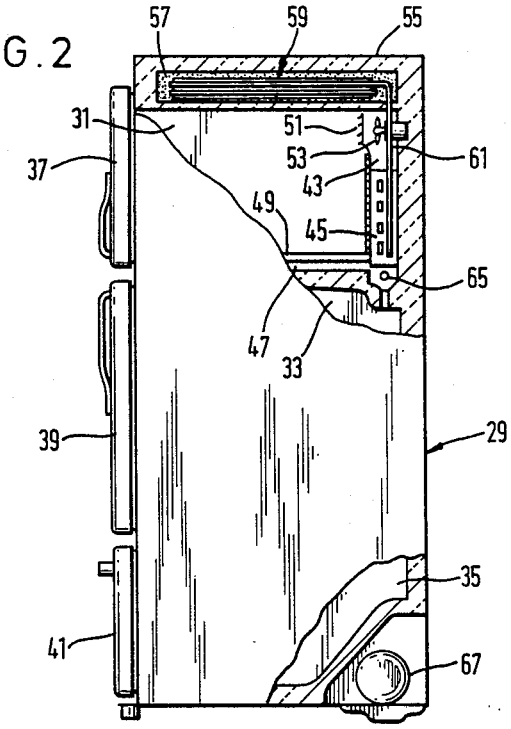
FIG. 2 is a side elevation partly in section of a refrigerator according to the present invention.

A refrigerator incorporating the invention is shown in FIG. 2. As is shown in FIG. 2, the interior of a main body 29 of the refrigerator is divided into a freezing compartment 31 above, a refrigerating compartment 33, in the middle, and a vegetable compartment 35 below. Heat insulation doors 37, 39, 41 are respectfully attached to the front of each compartment 31, 33, 35. At the rear of freezing compartment 9 there is formed a main evaporator compartment 43 which is being separated from the freezing compartment 9. The main evaporator compartment 43 has a main evaporator 45 therein, and the interior thereof communicates with the interior of the freezing compartment 31 through a return duct 47 formed in a heat insulation wall 49 constituting a partition between the freezing compartment 31 and the refrigerating compartment 33, and also through a cold air supply port 51 formed in an upper portion of the main evaporator compartment 43. A cold air circulation fan 53 is provided to the rear of cold air supply port 51. Fan 53 ejects cold air produced by the main evaporator 45 ejected into the freezing compartment 31, while air inside the freezing compartment 31 goes through the return duct 47 to return to the main evaporator compartment 43. Cold air produced by the main evaporator 45 is also ejected into the refrigerating compartment 33 through an air supply port of a supply duct (not shown) formed in a rear heat insulation wall, while air inside the refrigerating compartment 33 goes through the interior of the vegetable compartment 35 and the return duct 47 to return to the main evaporator compartment 43. To the air supply port of the supply duct (not shown), a damper (not shown) is provided in order to control the temperature in the refrigerating compartment 33. In a ceiling surface portion 55 of the refrigerator main body 29, there is provided a cold-accumulation material 57 which is enclosed in heat insulating materials and has a cold-accumulation evaporator 59 therein. A thermosiphon 61 provided with an electromagnetic valve 63 therein connects the cold-accumulation evaporator 59 to the main evaporator 45 in a manner permitting heat transfer. The thermosiphon 61 is constituted by a closed loop pipeline having operating fluid, such as, e.g., refrigerant, therein. And the portions of the closed loop pipeline next to both the main evaporator 45 and the cold-accumulation evaporator 59 are zigzag formed so as to improve heat exchange efficiency. A glass-tube defrosting heater 65 is provided below the main evaporator 45 so as to periodically remove frost accumulated thereon.

Figure 3:
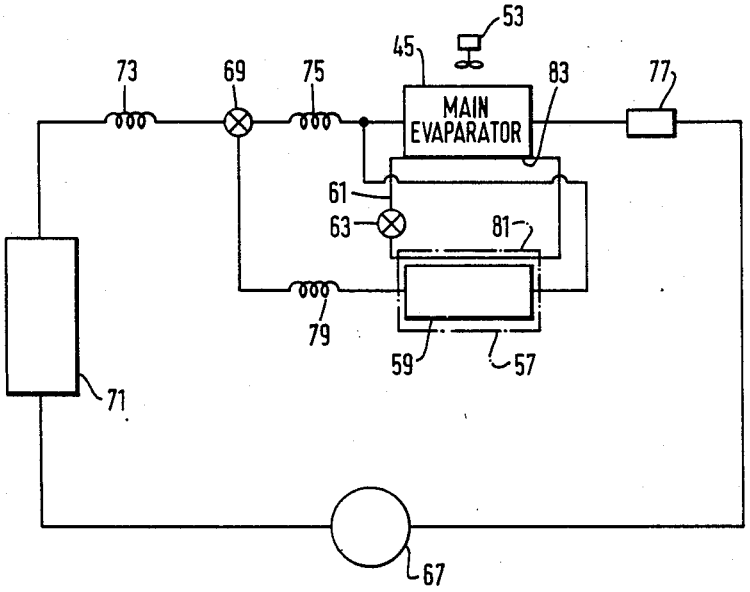
FIG. 3 is a schematic diagram of a refrigerating cycle according to the present invention.

The refrigerating cycle, according to the present invention, will be described with reference to FIG. 3. A discharge side of a compressor 67 is connected to an inflow side of a three-way electromagnetic valve 69 through a condenser 71 and a main capillary tube 73. This three-way electromagnetic valve 69 has two outflow ports which are selectable to change a flowpath of refrigerant. One outflow port of valve 69 connects to an inflow port of the main evaporator 45 through a first capillary tube 75. An outflow port of main evaporator 45 connects to an intake side of the compressor 67 through an accumulator 77, whereby there is established a refrigerant flowpath for an ordinary cooling operation to cool the main evaporator 45 and hence the interior of compartments. The other outflow port of valve 69 connects to an inflow port of the cold-accumulation evaporator 59 through a second capillary tube 79. An outflow port of the cold-accumulation evaporator 59 connects to the inflow port of the main evaporator 45, refrigerant flowing to the intake side of the compressor 67 through the main evaporator 45 and the accumulator 77, whereby there is established a refrigerant flowpath for a cold-accumulation operation to cool the cold-accumulation evaporator 59 and hence the cold-accumulation material. As noted above, the thermosiphon 61 performs heat exchange between the main evaporator 45 and the cold-accumulation evaporator 59. Its condensation part 81 is arranged in thermal contact with the cold-accumulation evaporator 59 and hence, the cold-accumulation material 57 and its evaporating part 83 is arranged in thermal contact with the main evaporator 45. By circulating working fluid within the closed-loop thermosiphon 61, the refrigerator compartments are cooled by the cold-accumulation material. The flow of working fluid within the thermosiphon 61 can be selectively cut off by the valve 63.

The operations of the compressor 67, the three-way electromagnetic valve 69, the cold air circulation fan 53, and the valve 63 are controlled at least in part by a temperature control device (not shown), such as, e.g., a microcomputer.

The operation of the refrigerating cycle constructed as described above will be now described. When ordinary cooling (first mode operation) is performed using the main evaporator 45, the three-way electromagnetic valve 69 is controlled so as to be in a first state in which liquid refrigerant flowing thereinto flows to the main evaporator 45 through the first capillary tube 75, the valve 63 in the thermosiphon 61 is closed, and the compressor 67 is driven. High-temperature and high-pressure gas refrigerant from the driving compressor 67, is condensed in condenser 71, decompressed in capillary tube 73, flows through valve 69 and capillary tube 75 to the main evaporator 45, fed into the main evaporator 45 through the three-way electromagnetic valve 69 and the first capillary tube 75. After being evaporated in the main evaporator 45, it returns to the compressor 67 through the accumulator 77. The main evaporator 45 is cooled by this circulation of refrigerant. Cold air generated therein is circulated in the refrigerator compartments by the cold air circulation fan 53 to cool them.

When the cold-accumulation material is used to cool the refrigerator compartments (second mode) the compressor 67 is not operated and the electromagnetic valve 63 in the thermosiphon 61 is opened. Consequently, in this condition, a cycle is repeated wherein the cold-accumulation material 57 causes the operating fluid in the closed-loop thermosiphon 61 to condense in the condensation part 81, while the operating fluid evaporates in the evaporating part 83. By this repeated cycle of the operating fluid in the thermosiphon, the main evaporator 45 is cooled by exchanging heat with the cold-accumulation material, thereby cooling the refrigerator compartments. During second mode operation, compressor 67 is not operated and less power is consumed to cool the refrigerator compartments than would be consumed if they were cooled by first mode operation.

When "cold" is being accumulated by using the cold-accumulation evaporator 59 (third mode), the three-way electromagnetic valve 69 is changed over to its second state in which liquid refrigerant flowing thereinto is fed to the cold-accumulation evaporator 59 through the second capillary tube 79, the electromagnetic valve 63 in the thermosiphon 61 is closed, and the compressor 67 is driven. Liquid refrigerant, which is condensed in the condenser 71 and decompressed in the main capillary tube 73 flows into the cold-accumulation evaporator 58 through the three-way electromagnetic valve 69 and the second capillary tube 79. After being evaporated in the cold-accumulation evaporator 59, it then flows to the main evaporator 45, where any extra liquid refrigerant fed thereto without being evaporated in the main evaporator 45 is again evaporated, and then returns to the compressor 67 through the accumulator 77. This circulation of refrigerant permits evaporator 59 to cool the cold-accumulation material 57. Excess liquid refrigerant that has not been completely evaporated in the cold-accumulation evaporator 59 is used to cool the main evaporator 45 and hence the refrigerator compartments. The amount of excess liquid refrigerant fed to the main evaporator 45 from the cold-accumulation evaporator 59 becomes larger in accordance with the degree of cold-accumulation. Also, the temperature in compartments of the refrigerator becomes higher in accordance with the degree of cold-accumulation if the excess liquid refrigerant is not fed to the main evaporator 45, because the three-way electromagnetic valve 69 has been changed over to its second state feeding all amounts of the liquid refrigerant flowing thereinto to the cold-accumulation evaporator 59. Therefore, excess liquid refrigerant can prevent the temperature in compartments from rising during the cold-accumulation operation.

During the cold-accumulation operation, the excess liquid refrigerant that has not been completely evaporated in the cold-accumulation evaporator 59 flows into the main evaporator 45 and is evaporated there, so that it cools the refrigerator compartments. This improves the cooling efficiency of the refrigerating cycle. Also, the amount of the liquid refrigerant flowing into the accumulator 75 is reduced, so this accumulator 75 can be reduced in size. This enables costs to be lowered and increase in the size of the refrigerator as a whole to be avoided, as well as improving the efficiency of ordinary cooling operation. Particularly, even though the compressor 67 is driven in high-speed by an invertor device during the cold-accumulation operation, and a large amount of liquid refrigerant is generated during the cold-accumulation operation, the phenomenon of liquid back-up is prevented. Moreover, because the cooling operation by the cold-accumulation material, during which the compressor 67 being halted, consumes less power than the ordinary cooling operation to cool the refrigerator compartment, the refrigerating devices provided with this refrigerating cycles can contribute to evening out power demand in a day by performing the cooling operation by the cold-accumulation material for a peak power demand period, such as, e.g., from 1:00 p.m. to 4:00 p.m.

The present invention has been described with respect to a specific embodiment. However, other embodiments, such as air conditions, based on the principles of the present invention should be obvious to those of ordinary skill in the art. Such embodiments are intended to be covered by the claims.

What is claimed is:

1. A refrigerating cycle comprising:

a cold accumulation material;

a main evaporator for generating cold air for cooling a refrigerator compartment;

a cold-accumulation evaporator for cooling the cold-accumulation material, an outlet thereof being connected to an input of the main evaporator;

a refrigerant supplying means for supplying refrigerant; and a flowpath switching means for supplying refrigerant from the supplying means via a first refrigerant flowpath to the main evaporator only and via a second refrigerant flowpath to the cold-accumulation evaporator and the main evaporator respectively.

2. A refrigerating cycle according to claim 1, wherein the flowpath switching means includes a three-way electromagnetic valve having an inlet coupled to said supplying means and to first and second outlets.

3. A refrigerating cycle according to claim 2, wherein the first refrigerant flowpath includes a first capillary tube connected between the first outlet of the three-way electromagnetic valve and the main evaporator, the outlet of the cold-accumulation evaporator being connected between the first capillary tube and the main evaporator.

4. A refrigerator according to claim 3, wherein the second refrigerant flowpath includes a second capillary tube being connected between the second outlet of the three-way electromagnetic valve and the cold-accumulation evaporator.

5. A refrigerating cycle according to claim 4, wherein the refrigerant supplying means comprises:

a compressor for generating a gas refrigerant;

a condenser connected in series to the compressor for condensing the gas refrigerant into a liquid refrigerant; and a capillary tube for decompressing the liquid refrigerant being connected in series between the condenser and the inlet of the three-way electromagnetic valve.

6. A refrigerating cycle according to claim 5, wherein the main evaporator includes a cold-air circulation fan for circulating the cold air generated thereby.

7. A refrigerating cycle according to claim 5 further including an accumulator for controlling and amount of refrigerant circulating therein.

8. A refrigerating cycle according to claim 6 further including an accumulator for controlling an amount of refrigerant circulating therein.

9. A refrigerating cycle according to claim 1 further including a heat transfer means for exchanging heat between the evaporator and the cold-accumulation material.

10. A refrigerating cycle according to claim 9, wherein the heat transfer means includes a thermosiphon connected with the main evaporator and the cold-accumulation evaporator.

11. A refrigerating cycle according to claim 10, wherein the thermosiphon includes a closed-loop pipe having a working fluid therein and having an evaporating part and a condensing part, the main evaporator being connected therewith at the evaporating part and the cold-accumulation evaporator being connected therewith at the condensing part.

12. A refrigerating cycle according to claim 11, wherein the main evaporator is provided below the cold-accumulation evaporator.

13. A refrigerating cycle according to claim 11, wherein the thermosiphon also includes an electromagnetic valve for controlling an operation of the working fluid, the electromagnetic valve being provided at a portion of the closed-loop pipe where evaporated working fluid flows.

14. A refrigerating cycle according to claim 13, wherein the flowpath switching means includes a three-way electromagnetic valve having one inlet and two outlets.

15. A refrigerating cycle according to claim 14, wherein the first refrigerant flowpath includes a first capillary tube being connected between the one outlet of the three-way electromagnetic valve and the evaporator, the outlet of the cold-accumulation evaporator being connected between the first capillary tube and the main evaporator.

16. A refrigerating cycle according to claim 15, wherein the second refrigerant flowpath includes a second capillary tube being connected between the other outlet of the three-way electromagnetic valve and the cold-accumulation evaporator.

17. A refrigerating cycle according to claim 16, wherein the refrigerant supply means includes:

a compressor for generating a gas refrigerant;

a condenser connected in series to the compressor for condensing gas refrigerant into a liquid refrigerant; and a capillary tube connected in series between the condenser and the inlet of the three-way electromagnetic valve for decompressing the liquid refrigerant.

18. A refrigerating cycle according to claim 17, wherein the evaporator includes a cold-air circulation fan for circulating the cold air generated thereby.

19. A refrigerating cycle according to claim 17, further including an accumulator for controlling an amount of refrigerant circulating therein.

20. A refrigerating cycle according to claim 18 further including an accumulator for controlling an amount of refrigerant circulating therein.

21. A refrigerating cycle method for use in a refrigerator having a cold-accumulation material, a cold accumulation evaporator to cool the cold-accumulation material, and a main evaporator for generating cold air to cool a refrigerator compartment, a refrigerant inlet thereof being connected with a refrigerant outlet of the cold-accumulation evaporator, comprising the steps of:

supplying refrigerant to the main evaporator only via a first refrigerant flowpath; and supplying refrigerant to the cold-accumulation evaporator and flowing refrigerant which has not completely evaporated in said cold accumulation evaporator into the main evaporator via a second refrigerant flowpath.

* * * * *